US006263847B1

(12) United States Patent
Hoffmann et al.

(10) Patent No.: US 6,263,847 B1
(45) **Date of Patent: *Jul. 24, 2001**

(54) BREATHER ASSEMBLY FOR AN INTERNAL COMBUSTION ENGINE

(75) Inventors: Mark A. Hoffmann, New Berlin; Paul J. Troxler, Brookfield, both of WI (US)

(73) Assignee: Harley-Davidson Motor Company Group, Inc., Milwaukee, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/448,025

(22) Filed: Nov. 23, 1999

Related U.S. Application Data

(63) Continuation of application No. 09/122,322, filed on Jul. 24, 1998, now Pat. No. 6,065,457.
(60) Provisional application No. 60/091,190, filed on Jun. 30, 1998.

(51) Int. Cl.[7] ..... F01L 1/18
(52) U.S. Cl. ..... 123/90.39; 123/572; 123/573
(58) Field of Search ..... 123/90.39, 90.38, 123/572, 573

(56) References Cited

U.S. PATENT DOCUMENTS

| | | | |
|---|---|---|---|
| 3,270,727 | 9/1966 | Nance . | |
| 4,169,432 | 10/1979 | White . | |
| 4,438,734 | 3/1984 | Hayashi . | |
| 4,459,966 | 7/1984 | Sakano et al. . | |
| 4,549,520 | 10/1985 | Tamba et al. . | |
| 4,602,607 | 7/1986 | Balsley . | |
| 4,686,946 | 8/1987 | Umeda et al. . | |
| 4,711,224 | 12/1987 | Eckhardt . | |
| 4,721,075 | 1/1988 | Kasai . | |
| 4,911,120 | 3/1990 | Sumi . | |
| 4,920,930 | 5/1990 | Sakano et al. . | |
| 4,920,943 | 5/1990 | Castellari . | |
| 4,926,814 | 5/1990 | Bonde . | |
| 4,969,434 | 11/1990 | Nakagawa . | |
| 4,995,352 | 2/1991 | Machino . | |
| 5,027,784 | 7/1991 | Osawa et al. . | |
| 5,058,542 | 10/1991 | Grayson et al. . | |
| 5,067,449 * | 11/1991 | Bonde | 123/41.86 |
| 5,205,243 | 4/1993 | Buchholz . | |
| 5,233,967 | 8/1993 | Peller . | |
| 5,421,292 | 6/1995 | Hoffman et al. . | |
| 5,474,035 | 12/1995 | Ming et al. . | |
| 5,487,371 * | 1/1996 | Beckman et al. | 123/572 |
| 6,047,670 * | 4/2000 | Stella et al. | 123/41.86 |
| 6,065,457 * | 5/2000 | Hoffman et al. | 123/572 |
| 6,161,529 * | 12/2000 | Burgess | 123/572 |

FOREIGN PATENT DOCUMENTS

| | | | |
|---|---|---|---|
| 2167810 * | 6/1986 | (GB) | 123/573 |

OTHER PUBLICATIONS

Harley–Davidson Motor Company Service Manual, XLH Models. 1993 and 1994 Official Factory Manual, pp. 3–13 and 3–40.
1340 Models 1993 and 1994 Parts Catalog—p. 6 undated.

* cited by examiner

*Primary Examiner*—Thomas Denion
*Assistant Examiner*—Jaime Corrigan
(74) *Attorney, Agent, or Firm*—Michael Best Friedrich LLP

(57) ABSTRACT

A rocker support assembly for a motorcycle internal combustion engine. The assembly comprises a pair of rockers positioned in spaced relation from each other, a breather housing, and a pressure-responsive member. The housing at least partially defines an inlet aperture, an outlet aperture, and a passage in fluid communication between the inlet aperture and the outlet aperture. The passage is positioned substantially between the rockers. The pressure-responsive member is disposed in the passage and is operable in response to pressure differences in the passage to permit or inhibit fluid flow through the passage from the inlet to the outlet. A filter element is disposed within the housing such that substantially all fluid flowing from the inlet aperture to the outlet aperture passes through the filter element.

12 Claims, 3 Drawing Sheets

18
10
26
72
34
3
47
44
46
24
40
48
70
50
20
38
42
32
90
14
100
22
27
98
96

15
10
65
22
34
28
32
72
50b
82
56
64
70
54
68
74
58
52
30
20
50a
98
92
27
44
89
22
80
60
66
78
76
88
86
84
50
96
100
90
91
AIR CLEANER
14
16
CARBURETOR 65
56
58
64
56
70
68
54
52
78
60
80
50
66
62

BREATHER ASSEMBLY FOR AN INTERNAL COMBUSTION ENGINE

This application is a continuation of application No. 09/122,322, filed Jul. 24, 1998 now U.S. Pat. No. 6,065,457 which claims benefit of Provisional No. 60/091,190 filed Jun. 30, 1998.

FIELD OF THE INVENTION

The present invention relates to rocker support assemblies and breather assemblies for internal combustion engines.

BACKGROUND

Combustion gases produced in the combustion chamber of an internal combustion engine are commonly forced under pressure to flow past the piston of the engine and into the engine's crankcase. Such gas is called "blow-by" gas, and usually consists at least partially of an air/oil mist. The reciprocation of the piston typically causes pressure fluctuations in the crankcase, causing the air/oil mist in the crankcase to be routed through an air cleaner having an air filter and back to the intake of the carburetor. It is undesirable to have oil in the combustion chamber because this leads to accumulations of oil in the valves and combustion chamber which may interfere with the operation of the engine. Also, the air filter in the air cleaner must be replaced frequently due to larger amounts of oil suspended in the air passing through the air cleaner, adding maintenance expense.

To alleviate this problem, it is customary in a four cycle engine to provide a breather system for separating the oil from the air/oil mist prior to recycling the air through the air cleaner and the carburetor. In a typical breather system as shown in U.S. Pat. No. 4,169,432, the oil mist in the crankcase is subjected to positive pressure when the piston travels in a downstroke, and the oil mist is forced through a breather passage containing a check or breather valve to an oil separation chamber where the oil mist is separated from the gas. On the upstroke of the piston, the pressure in the crankcase changes from positive to negative and the separated oil is drawn back into the crankcase through a return passage.

SUMMARY

The present invention provides a rocker support assembly for an internal combustion engine of a motor vehicle (e.g., a motorcycle). The rocker support assembly includes a pair of rockers and a breather assembly including a breather housing that is advantageously positioned between the rockers. Such positioning of the breather housing provides a compact, low profile rocker box. Furthermore, by properly positioning the rockers, the breather housing can be positioned in the middle of the rocker box to enhance the efficiency of the breather system.

In one embodiment, the housing at least partially defines an inlet aperture, an outlet aperture, and a passage in fluid communication between the inlet aperture and the outlet aperture. A pressure-responsive member is positioned in the housing and is operable in response to pressure differences in the passage to permit or inhibit fluid flow through the passage from the inlet to the outlet. A filter element can also be disposed within the housing such that substantially all fluid flowing from the inlet aperture to the outlet aperture passes through the filter element.

Other principal features and advantages of the invention will become apparent to those skilled in the art upon review of the following drawings, the detailed description and the appended claims.

DETAILED DESCRIPTION

Figure 1:
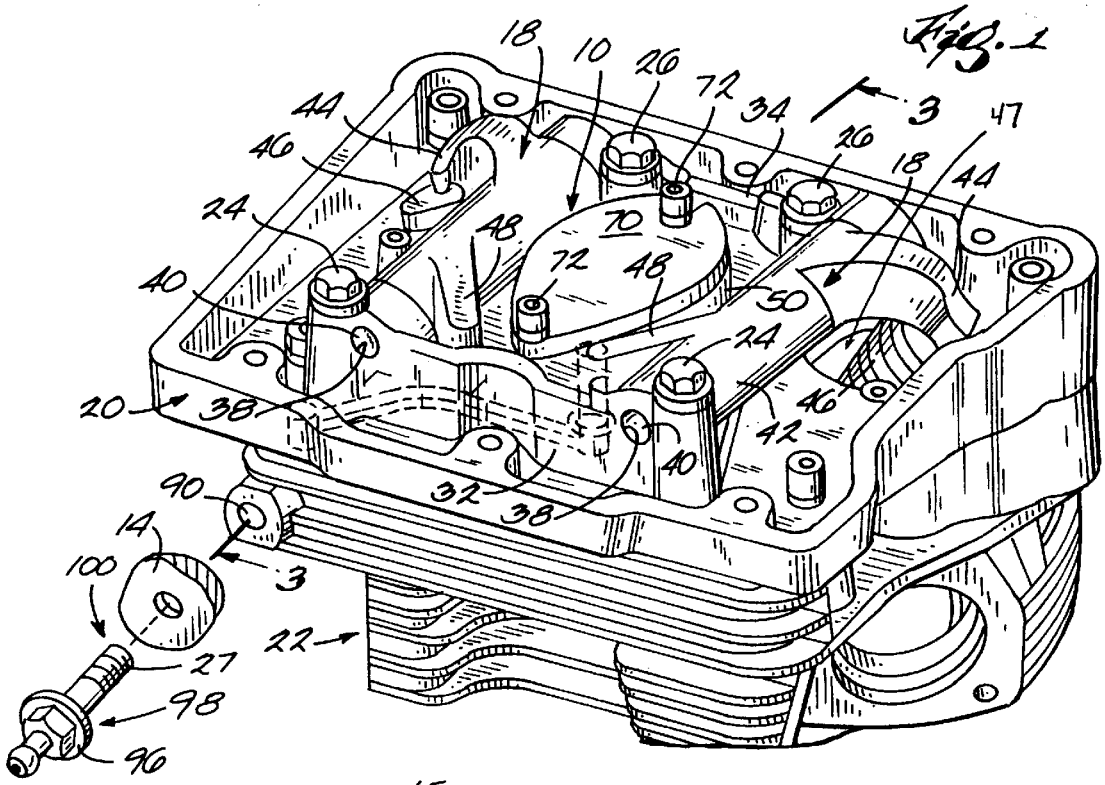
FIG. 1 is a perspective view of a rocker box assembly according to the invention with the cover of the rocker box removed to show the breather assembly.

FIG. 1 illustrates a breather assembly 10 mounted on a rocker support assembly 18 to separate oil from an air/oil mist before the air passes to an air cleaner 14 and a carburetor 16. The rocker support assembly 18 is mounted on the surface of a lower portion 20 of a rocker box 15 mounted on a cylinder head 22 (FIG. 5) by means of bolts 24 and 26. The air cleaner 14 is mounted to the cylinder head 22 by breather bolts 27. A rocker box cover 28 (FIG. 3) is mounted on the lower rocker box 20 to enclose the breather assembly 10 and the rocker support assembly 18.

Figure 3:
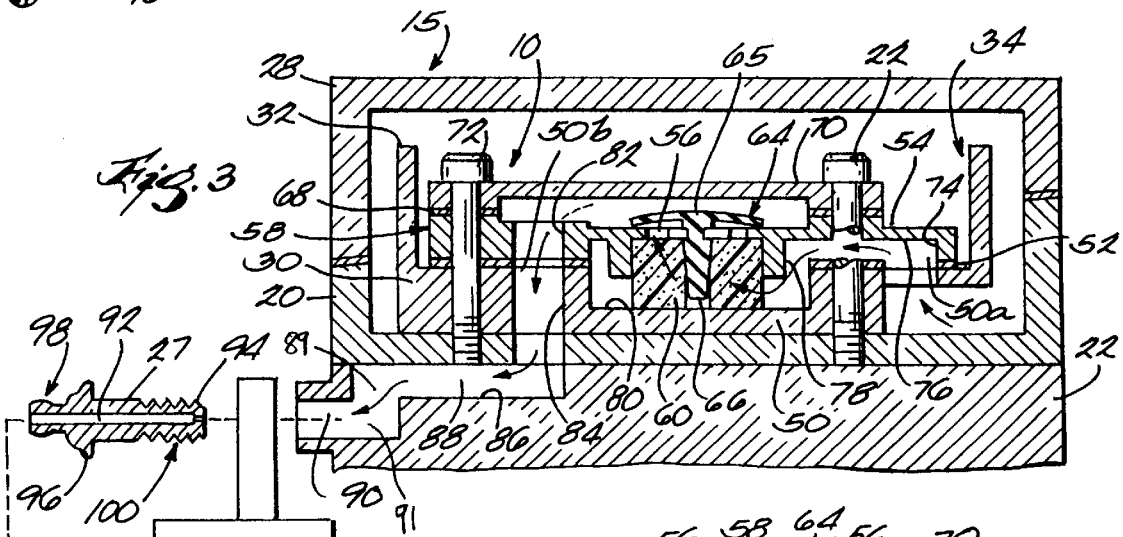
FIG. 3 is a cross-section view taken along line 3—3 of FIG. 1.
Figure 4:
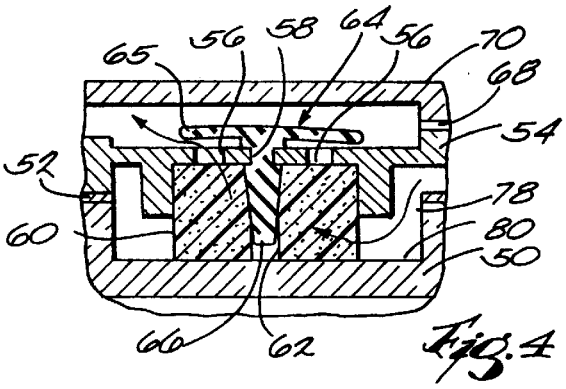
FIG. 4 is a cross-section view of a portion of the breather assembly, showing the pressure-responsive member in the open position.
Figure 2:
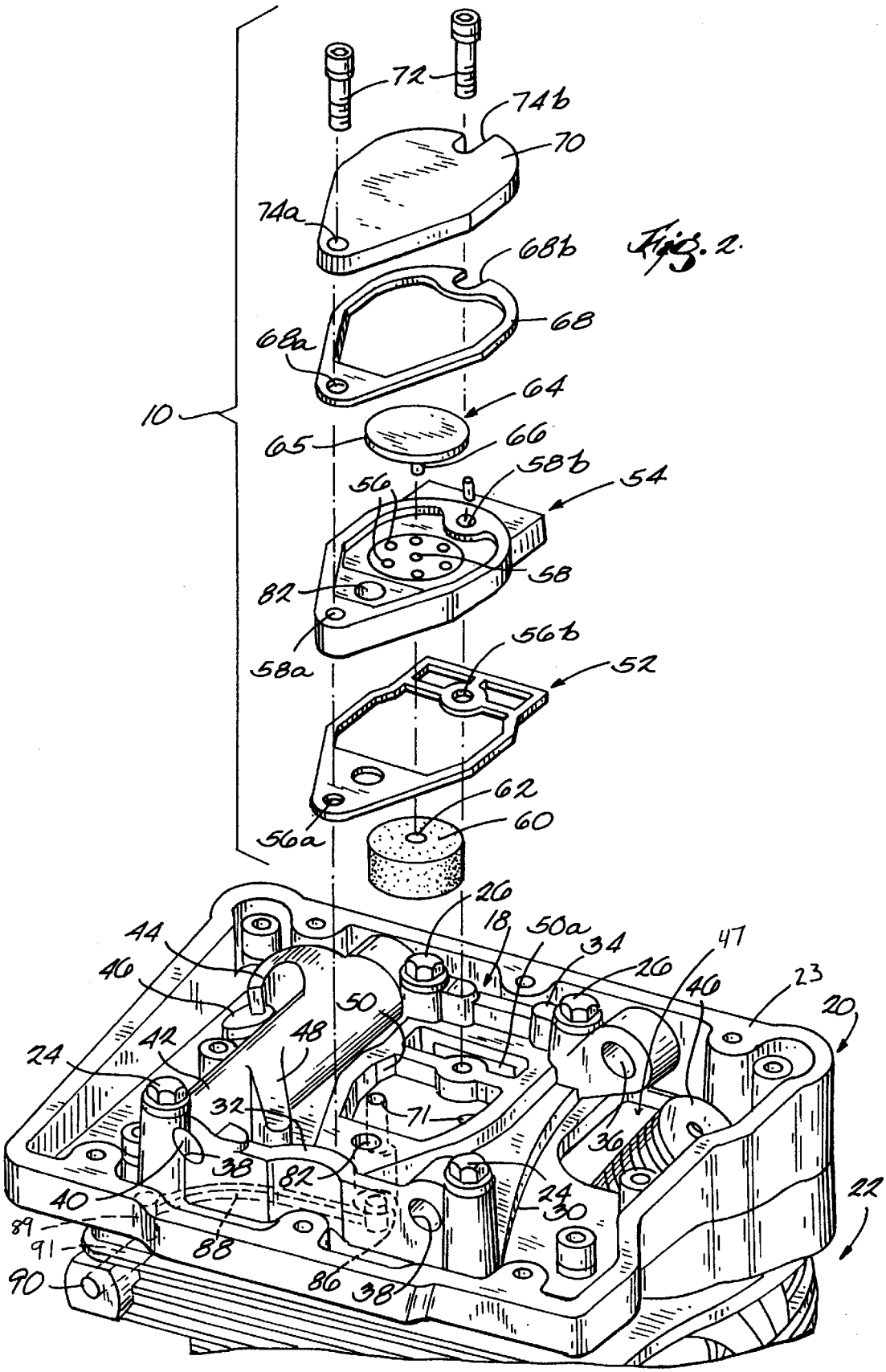
FIG. 2 is an exploded view of the breather assembly.

Referring now to FIGS. 2–4, the illustrated rocker support assembly 18 includes a base member or plate 30 having end members or plates 32 and 34 formed integrally or interconnected with each end of the base member 30. Each end member 32, 34 includes a pair of openings 36, 38, respectively, for supporting rocker pins 40 in a parallel spaced relation between the end members 32 and 34. A rocker 42 is mounted on each of the rocker pins 40 and retained thereon by the bolts 24 which intersect the pins 40. Each rocker 42 includes an arm 44 aligned with valves 46 and an arm 48 aligned with the engine's push rods (not shown).

The illustrated breather assembly 10 includes a breather housing including a frame member 50, a baffle member 54, and a cover member 70. The frame member 50 is integrally formed or interconnected with the base member 30 intermediate the rockers 42. The frame member 50 at least partially defines an inlet aperture or opening 50*a* and an outlet aperture or opening 50*b* spaced from the inlet aperture 50*a*.

A baffle gasket 52 is aligned with the frame member 50 and retained therein by a baffle member or plate 54 having a plurality of openings 56 arranged generally around a valve stem opening 58. The baffle gasket includes mounting apertures 56*a*, 56*b* aligned with apertures 58*a*, 58*b* in the baffle member 54. The frame member 50, together with the base member 30 and the baffle member 54, define an oil separator chamber 59 (FIGS. 3 and 4). The openings 56, 58 are in fluid communication with the separator chamber 59. The breather assembly 10 also includes a generally cylindrical filter element 60 having an opening or bore 62 therethrough and positioned within the separator chamber 59.

A pressure-responsive member 64, which in the illustrated embodiment is a resilient umbrella check valve, is provided, and includes a covering portion 65 and a stem 66. In the illustrated embodiment, the stem 66 is inserted into the stem opening 58, and passes into the bore 62 of the filter 60 disposed below the baffle plate 54. The covering portion 65 covers the openings 56 and stem opening 58 in the baffle plate 54.

Figure 5:
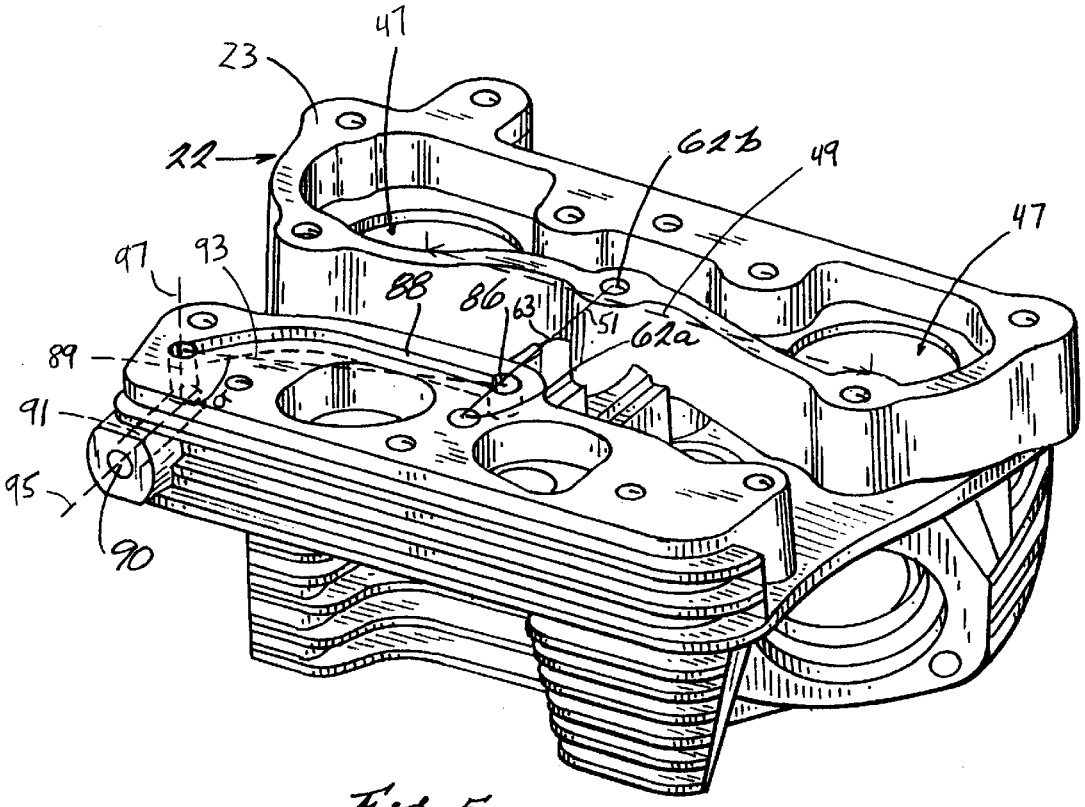
FIG. 5 is a perspective view of the cylinder head.

A cover gasket 68 is aligned with the baffle member 54, and retained thereon by a cover member 70. Cover gasket 68 includes mounting apertures 68*a*, 68*b* aligned with mounting apertures 74*a*, 74*b* in the cover 70. In this regard the cover member 70, cover gasket 68, baffle member 54, and baffle gasket 52 are secured to the frame 50 by bolts 72 which pass through the apertures 74*a*, 74*b*; 68*a*, 68*b*; 58*a*, 58*b*; 56*a*, 56*b*; and threaded openings 62*a*, 62*b* (FIG. 5).

In operation the air/oil mist or mixture enters the rocker box 15 through push rod tubes (not shown). The air/oil mist enters the rocker box 15, migrates across the rocker box 15, and enters the space between the baffle member 54 and the frame member 50 through the inlet aperture 50*a* at a first end of the frame member 50. The air/oil mist makes a 90° turn at 76 (FIG. 3) and then a second 90° turn at 78 (FIGS. 3 and 4) which causes the oil particles in the air/oil mist to accumulate on the surface 78 and then drop onto a bottom surface 80 of the base member 30 in the separator chamber 59. The oil that accumulates on the bottom surface 80 of the base member 30 passes through holes 71 (FIG. 2) back into the rocker box and eventually flows back into an oil sump (not shown).

The air/oil mist then passes into the filter element 60 which separates any remaining oil from the air which then passes through the filter 60 and the openings 56 in the baffle member 54. In the illustrated embodiment, the openings 56 are arranged in a circular pattern with the stem opening 58 substantially in the center of the circle to provide a balanced upward force on the covering portion 65. As air is forced under pressure through the openings 56, the pressure-responsive member 64 is forced away from the baffle member 54 (FIG. 4) to allow the air to pass through. On the upstroke of the piston, negative pressure is created in the crankcase, causing the pressure-responsive member 64 to seat tightly against the baffle member 54, thus closing the openings 56.

The air that passes through openings 56 and past the pressure-responsive member 64, is discharged through passage 82 in the baffle member 54 and the outlet aperture 50*b* in frame member 50 into a trough 86 in the cylinder head and discharges through passage 88 and the opening 90. The air passes through the opening 90, through a passage 92 defined in the breather bolt 27, and into the air cleaner 14 and carburetor 16. The breather bolt passage 92 includes a portion of reduced diameter, or a metering orifice 94. The metering orifice 94 serves to dampen pressure pulses or fluctuations within the breather assembly 10 to help prevent or reduce flutter of the pressure-responsive member 64 and the discharge of oil from the breather assembly 10 into the air cleaner 14 and carburetor 16. The breather bolt 27 also includes a flange 96 that abuts the housing of the air cleaner 14, such that a first portion 98 of the breather bolt 27 extends into the air cleaner housing and a second threaded portion 100 is threaded into the opening 90 in the cylinder head 22.

It should be noted that the outlet aperture 50*b* does not necessarily have to be on an opposite side of the breather assembly 10 from the inlet aperture 50*a*, as illustrated, to achieve the desired separation of the oil from the air/oil mist. Also, the turns at 76 and 78 do not necessarily have to be 90°, but should create a substantially serpentine path.

Although particular embodiments of the present invention have been shown and described, other alternative embodiments will be apparent to those skilled in the art and are within the intended scope of the present invention. For example, the base member may be integrally formed with the frame, and the baffle may be integrally formed with the frame. Alternatively, the entire tower breather assembly could be made as a single piece that is discarded after use. Thus, the present invention is to be limited only by the following claims.

What is claimed is:

1. An engine for use on a motorcycle, the engine comprising:

at least one cylinder;

a cylinder head mounted on said cylinder: and a rocker support assembly mounted on said cylinder head and including a pair of rockers positioned in spaced relation from each other a breather housing at least partially defining an inlet aperture, an outlet aperture, and a passage in fluid communication between said inlet aperture and said outlet aperture, wherein said passage is positioned substantially between said rockers, and a pressure-responsive member disposed in said passage, and operable in response to pressure differences in said passage to permit or inhibit fluid flow through said passage from said inlet to said outlet.

2. The engine of claim 1, further comprising a filter element disposed within said housing such that substantially all fluid flowing from said inlet aperture to said outlet aperture passes through said filter element.

3. The engine of claim 1, wherein said passage defines at least one substantially right-angle turn.

4. The engine of claim 1, wherein said passage defines a plurality of substantially right-angle turns.

5. The engine of claim 1, wherein said housing comprises:

a frame member;

a cover member; and a baffle member positioned between said frame member and said cover member, said baffle member at least partially defining said passage and defining a valve aperture in fluid flow communication between said inlet aperture and said outlet aperture, wherein said pressure-responsive member is operable in response to pressure differences in said passage to permit or prevent fluid flow through said valve aperture.

6. The engine of claim 1, wherein said pressure-responsive member is an umbrella valve.

7. The engine of claim 1, wherein said passage is adapted to permit an oil/air mixture to pass therethrough, and wherein said housing defines a plurality of draining apertures in fluid flow communication with said passage, said draining apertures permitting the oil to drain from said passage.

8. A motorcycle comprising:

an engine having at least one cylinder and a cylinder head mounted on said cylinder: and rocker support assembly mounted on said cylinder head, said rocker support assembly including:

a pair of rockers positioned in spaced relation from each other, a breather housing at least partially defining an inlet aperture, an outlet aperture, and a passage in fluid communication between said inlet aperture and said outlet aperture, wherein said passage is positioned substantially between said rockers, and a filter element disposed within said housing such that substantially all fluid flowing from said inlet aperture to said outlet aperture passes through said filter element.

9. The motorcycle of claim 8, wherein said filter element is adapted to separate oil from air/oil mist passing through said housing.

10. The motorcycle of claim 8, wherein said housing comprises:

a frame member;

a cover member; and a baffle member positioned between said frame member and said cover member, said baffle member at least partially defining said passage.

11. The motorcycle of claim 8, wherein said passage is adapted to permit an oil/air mixture to pass therethrough, and wherein said housing defines a plurality of draining apertures in fluid flow communication with said passage, said draining apertures permitting the oil to drain from said passage.

12. The motorcycle of claim 11, wherein said draining apertures are positioned below said filter element.

* * * * *

UNITED STATES PATENT AND TRADEMARK OFFICE
Certificate

Patent No. 6,263,847 B1 Patented: July 24, 2001

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Mark A. Hoffmann, New Berlin, WI; Paul J. Troxler, Brookfield, WI; and Henry M. Hubbard, Menomonee Falls, WI.

Signed and Sealed this Second Day of November 2004.

THOMAS E. DENION
*Supervisory Patent Examiner*
Art Unit 3748